US006393718B1

(12) United States Patent
Harris et al.

(10) Patent No.: US 6,393,718 B1
(45) Date of Patent: May 28, 2002

(54) HAND HELD HAIR DRYER

(75) Inventors: David Harris; Rudy Woodard, both of Nashua, NH (US)

(73) Assignee: Brookstone Company, Inc., Nashua, NH (US)

( * ) Notice: Subject to any disclaimer, the term of this patent is extended or adjusted under 35 U.S.C. 154(b) by 0 days.

(21) Appl. No.: 09/634,939

(22) Filed: Aug. 8, 2000

Related U.S. Application Data

(60) Provisional application No. 60/219,373, filed on Jul. 19, 2000.

(51) Int. Cl.[7] ..... A45D 23/00
(52) U.S. Cl. ..... 34/96; 361/213; 392/385
(58) Field of Search ..... 34/96, 97; 73/865.5; 361/213; 392/385

(56) References Cited

U.S. PATENT DOCUMENTS 4,196,343 A * 4/1980 Han ..... 392/385
4,258,408 A * 3/1981 Cantelli ..... 361/213
4,683,369 A * 7/1987 Rieckman et al. ..... 392/385
6,145,391 A * 11/2000 Pui et al. ..... 73/865.5
6,188,837 B1 * 2/2001 Kwan ..... 392/385
6,191,930 B1 * 2/2001 Ramchandani ..... 361/213

* cited by examiner

*Primary Examiner*—Teresa Walberg
*Assistant Examiner*—L Fastovsky
(74) *Attorney, Agent, or Firm*—Hayes Soloway P.C.

(57) ABSTRACT

A hand-held hair dryer which includes a negative ion generator and a corona discharge operating between a pin in the ion chamber and the grid at the outlet of the barrel for injecting a continuous supply of ions into the heated air stream. The hair dryer has an infrared on/off sensor switch which automatically activates the device when picked up by the user and a separate cooling switch to lower the heat level while maintaining the same air volume. The hair dryer includes a self-contained cord retractor which employs a fail-safe microswitch preventing operation unless electric cord is fully unreeled. Separate push button controls and readouts covered by a single membrane are attached on the body of the unit to control speed and ionizer function.

23 Claims, 2 Drawing Sheets

HAND HELD HAIR DRYER

This application claims benefit of provisional application 60/219,373 filed Jul. 19, 2000.

FIELD OF THE INVENTION

The present invention relates to a personal hand-held hair drying device, and more particularly, to a hand-held hair dryer having an ion generator for injecting a continuous supply of ions into the heated air stream, an automatic infrared on/off sensor switch and separate cooling switch, independent controls for setting the speed and ionizer elements, and including a self-contained cord retractor.

BACKGROUND OF THE INVENTION

Hand-held hair dryers are well known in the art. Such hair dryers include a handle attached to a blower or outlet part having a fan unit for drawing air though an air inlet driven by an electric motor with adjustments for speed and volume. The heated air passes through heating elements and exits the air outlet. Such hair dryers often include adjustments for speed, heat level and air volume, however the amount of heat required to dry the hair can make the hair brittle and lifeless. In addition, static electricity generated by conventional hair dryers makes setting or styling the hair more difficult.

To address these shortcomings, UK Patent Application GB 2,067,072 describes a device for dissipating the electrostatic charge by using an ion generator to provide a flow of ions of fixed polarity. However, depending upon the treatment or styling techniques used, the degree to which the hair is charged may vary. For example, the material of which the comb is made may affect the static electricity charge on the hair. Therefore, unless the degree to which the hair is charged is known in advance, the ion charge generated by the ion generator may not be appropriate and actually may intensify the charge on the hair rather than neutralizing it.

It has also been known to produce electrons by means of a piezoelectric crystal. U.S. Pat. No. 5,612,849 provides a needle shaped point source centered in the air outlet of the hair dryer electrically connected to a piezoelectric crystal. The piezoelectric crystal is mechanically compressed producing electrons upon both compression and release. This ionizes the air, which is then carried to the hair. Piezoelectric crystals provide alternating electric charges upon compression and release thereby offsetting each other in sequence. This flow of charges of opposite polarity, while reducing static electricity does not fully solve the problem since it reintroduces positive charge to the hair. In addition, the piezoelectric device is somewhat complicated and after a period or prolonged use may lose its piezoelectric properties.

U.S. Pat. No. 5,805,406 describes a hair dryer having at least two ion emitters, simultaneously emitting positive and negative ions respectively, in equal amounts. While this may neutralize the charge of the hair, both positive and negative ions continue to be produced well after, providing no additional benefit and producing unwanted damaging ozone. Moreover, two emitters require more power to operate and if one emitter breaks down, the other will remain operational. For example, if only the positive ion emitter is working, the undesired result is obvious.

It has been found that introduction of a continuous supply of ions into the air stream employing a corona discharge operating between a pin in an ion chamber and a grid adjacent the hair drier air exit, neutralizes the ions which damage the hair and promotes the hair drying process while reducing the amount of heat required. At the same time the charged ions fortify the hair. As a result, the hair is more manageable and looks and feels better and thicker. In addition, drying time is shortened and less electricity is used compared to other dryers. A cooling switch drops the heat level and introduces a burst of cool air to assist with setting and styling.

SUMMARY OF THE INVENTION

The present invention provides a hand-held hair dryer with a corona discharge ion generator operating between a pin and a grid adjacent the outlet of the hair drier for injecting a continuous supply of ions into the heated air stream. The ions generated may be negatively charged or positively charged.

In the preferred embodiment, the hair dryer includes an elongated contoured handle, a control panel including an infrared power on/off sensor switch which automatically activates the hair dryer when it is picked up and deactivates the hair dryer when it is put down, and a separate cooling switch to lower the heat level while maintaining the same air volume. Preferably, the hair dryer includes a self-contained cord retractor which employs a fail-safe microswitch preventing operation unless the electric cord is unreeled. Separate push button controls and readouts covered by a single membrane are attached on the body of the unit to control speed and ionizer function. In a preferred embodiment, separate controls and readouts setting the speed of the air volume, and the ionizer function, preferably in the form of touch sensitive buttons maintained beneath a thin rubber-like, flexible membrane, are mounted on the inside of the contoured handle. The thin flexible membrane covers the individual buttons thereby preventing introduction of powders, fluids, oils or the like, into the switches while allowing independent setting of the controls.

BRIEF DESCRIPTION OF THE DRAWINGS

These and other objects, features and advantages of the present invention will be batter understood with reference to the detailed description of the preferred embodiment and the accompanying drawings, wherein.

BRIEF DESCRIPTION OF THE PREFERRED EMBODIMENTS

Figure 1:
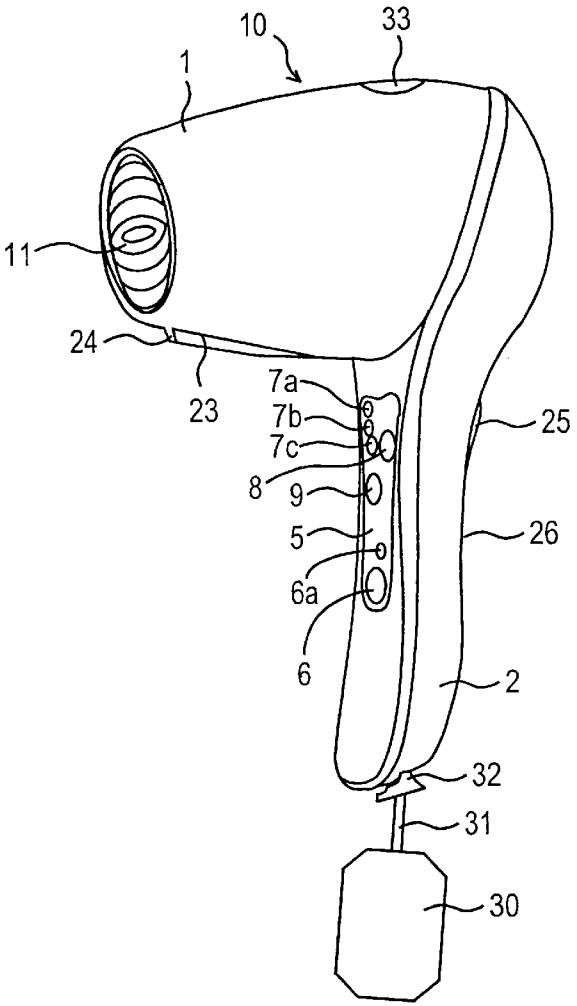
FIG. 1 is a perspective view of the hand-held hair dryer in accordance with the present invention.

FIG. 1 shows a hand-held hair dryer 10 which includes housing including an elongated barrel 1 and a handle grip 2, contoured so as to be comfortably grasped in the hand of the user. The handle grip 2 includes control panel 5 on the inner side of the grip and cool shot button 25 for lowering the heat level while maintaining the same air volume and infrared power on/off sensor switch 26 for powering up the hair drier, located on the outer side of the handle grip. The control panel 5 is covered with a thin flexible elastomeric membrane activator switch cover 5 formed of silicone rubber or the like and covering a plurality of touch sensitive capacitive control switches, and indicator lights, including ionizer switch 6, ionizer indicator light 6*a*, plus and minus speed setting control buttons 8 and 9, respectively, and blower speed indicator lights 7*a*, 7*b* and 7*c*. Membrane activator switch cover 5 keeps hair spray, mousse, oils, powder, fluids or the like from gumming up the switches, which in turn makes cleaning easier and provides longer operational life.

Air outlet 11 is located at the distal end of the barrel and covered by a grounded metal or metallized gird 11*a*. Located below the air outlet is an ion channel 23 having mounted therein a corona discharge wire or pin 24. A continuous supply of ions is generated between the corona discharge wire or pin 24 at the end of the ion channel 23 and the grounded metal or metallized grid 11*a* at the air outlet 11, which are picked up and carried by the adjacent air stream.

A cool shot button 25 permits instantaneous cut-off of the heating elements 16 thereby permitting the user to lower the heat output of the drier while maintaining the same air flow volume. When cool shot button 25 is released, the heating elements are reactivated thereby permitting the heat output level to return to its previous setting. Power to the hair dryer is provided by electricity through AC plug connection 30 and cord 31 located at the end of handle 2. Alternatively, power may be provided by a rechargeable battery housed within the hair dryer and chargeable through a connection at the end of handle 2 (not shown).

Figure 2:
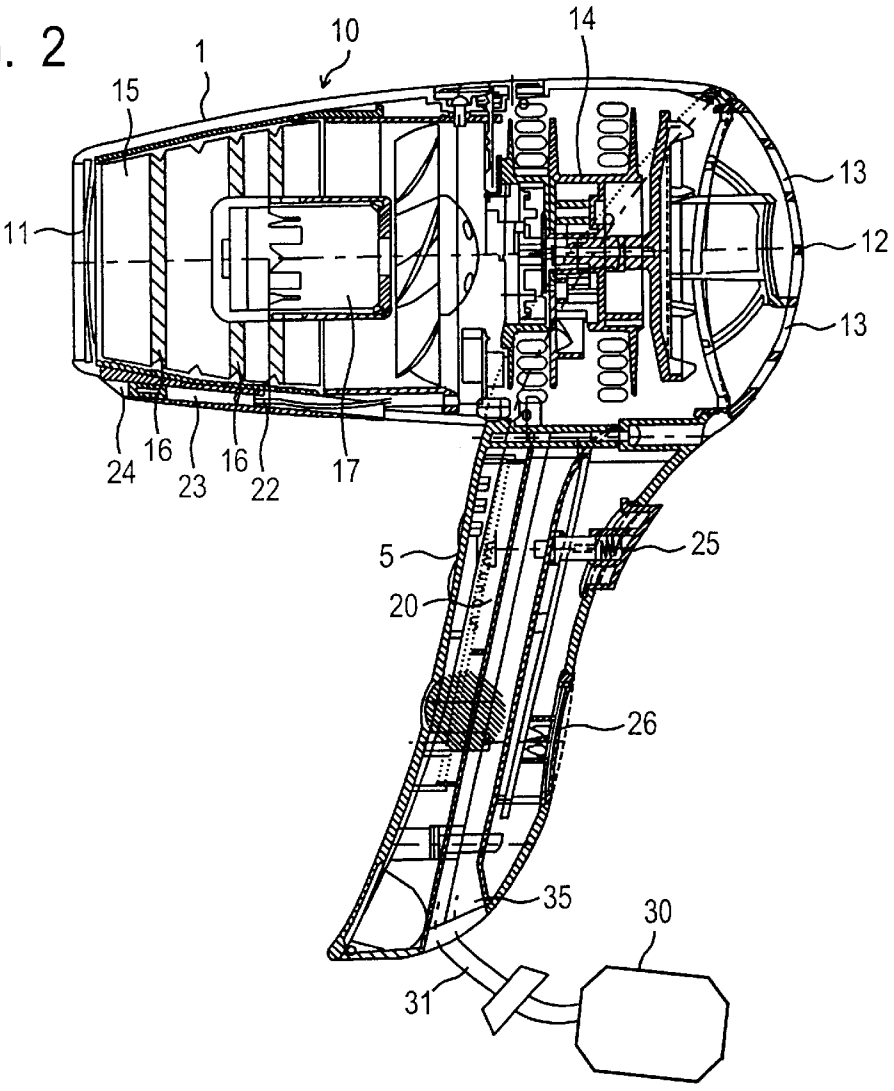
FIG. 2 is a cross-sectional diagrammatic view of the hand-held hair dryer shown in FIG, 1.

Turning now to FIG. 2, the hair drier 10 of the present invention includes the well-known components of a hair dryer. A fan 17 provides air flow over the heating elements 16, through primary air passage 15 of the hair dryer. The heated air stream exits the hair dryer through air outlet 11. When the hair dryer is in operation and ionizer switch 6 is in the on position, a charge is produced by ion generator 20 and delivered by wire 22 to corona pin 14 where the charge is discharged across the grounded grid 11*a*, and taken up by the air stream flowing from air outlet 11. The introduction of a continuous supply of ions into the heated air stream, neutralizes the ions which damage the hair and promotes the hair drying process while reducing the amount of heat required.

In the preferred embodiment, the speed setting control buttons 8 and 9 for controlling the blower fan 17 and the heating elements 16, ionizer switch 6 and ion generator 20, and cool shot button 25, Work generally independently of each other, provided the blower fan is operating, such that while the hair dryer is in operation, the ionizer and the cool shot may be turned on or off as desired. Alternatively, the hair dryer may have separate switches to independently control the heat level produced by heating elements 16 and the volume of air produced by fan 17 so that the hair dryer also may be used with only the ion generator 20 and fan 17 turned on, for example, to reduce static electricity. This will provide the user with a greater range of variation of the air volume, heat and ionizing effect of the device to attain the desired result.

To operate the hair dryer, the user extends cord 31 located at the opening end of handle 2 via cord passage 35. Preferably, and in order to prevent possible overheating of the reeled cord, the cord retractor employs a fail-safe microswitch (not shown) preventing operation unless electric cord is fully unreeled. When the user is finished, cord 31 may be retracted back into hair dryer housing 1 by pushing cord reel retractor button 33 located on the upper side of the housing, above the cord reel mechanism 14, such that the cord 31 is automatically retracted via cord passage 35 by cord reel retractor mechanism 14. In the preferred embodiment, a cord stopper 32 is provided adjacent the distal end of the cord, i.e. adjacent plug 30 to terminate the rewinding process and protect both the handle 2 and plug 30.

Figure 4:
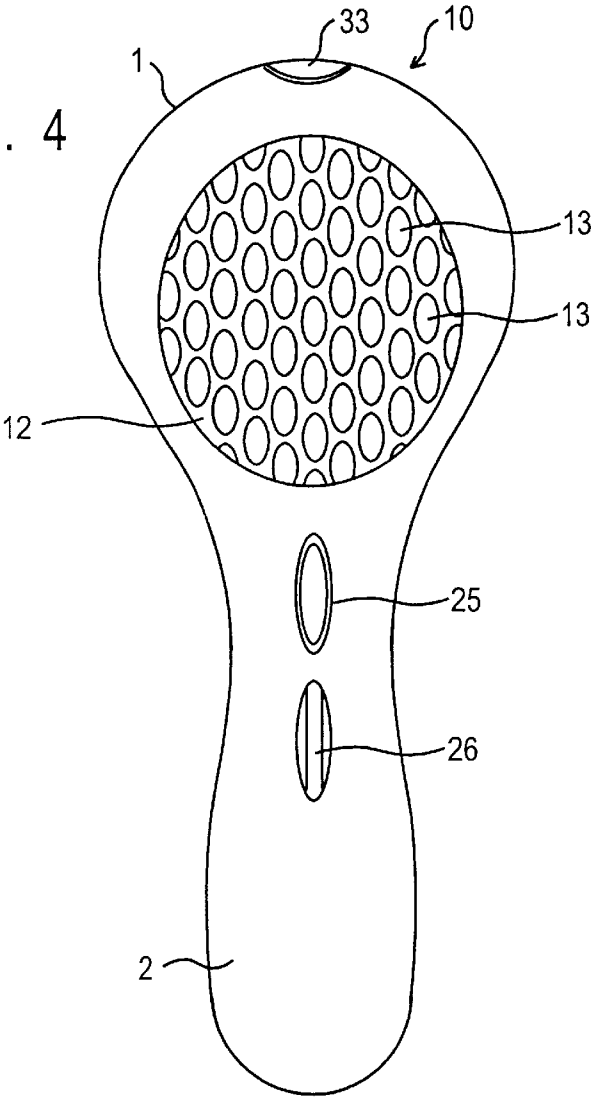
FIG. 4 is a rear end view of the hand-held hair dryer of FIG. 1.
Figure 3:
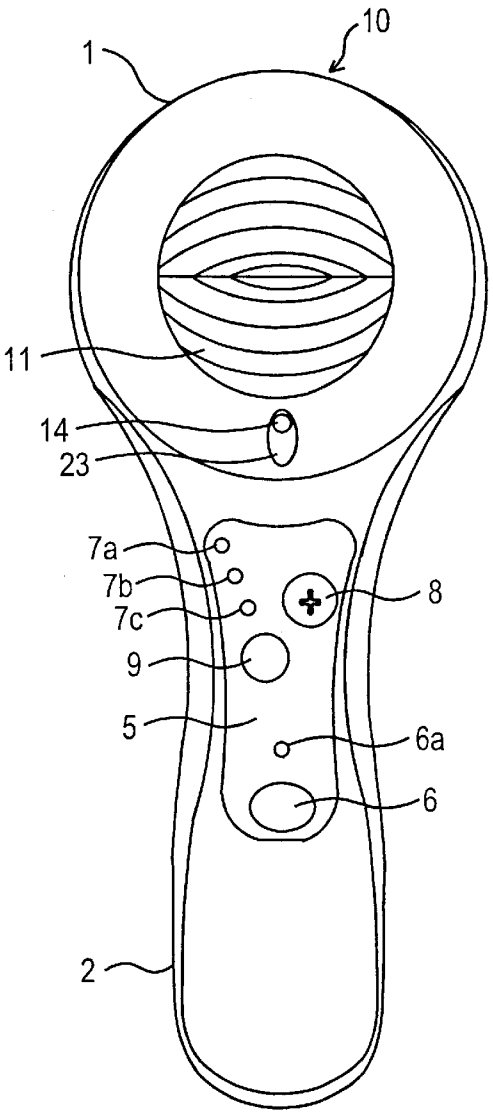
FIG. 3 is a front end view of the front of the hand-held hair dryer of FIG. 1.

Referring in particular to FIGS. 3 and 4, a power on/off infrared sensor switch 26 is located on the outer side of the handle grip 2. Handle grip 2 is contoured so that when the hair drier is picked up by the user, the palm of the user's hand will cover infrared power on/off sensor switch 26 located on the outer side of the handle grip, automatically powering-up the hair dryer, while permitting the user to easily manipulate the touch sensitive speed buttons 8, 9 and ionizer button 6. Separate cooling switch 25 is arranged above the infrared power sensor switch 26 and is easily manipulated by the user to lower the heat level while maintaining the same air volume. When the hair dryer is put down and the user releases his grasp, the sensor 26 automatically deactivates the hair dryer. In the preferred embodiment, the outer side of contoured handle grip 2 has an outer cushioned surface formed of a resilient material such as rubber or other suitable cushioning material covering the harder plastic underneath, that is easily and comfortably gripped. Removable cover 12 covers air intake 13 at the rear of the device.

Although described in terms of the presently preferred embodiment, those skilled in the art will appreciate that the present invention is not limited to the embodiment described. For example, power on/off sensor switch 26 may comprise a capacitance switch.

What is claimed is:

1. A hand-held hair dryer comprising:

a housing including an elongated barrel connected to a handle, said barrel having an air intake and air outlet, a variable speed blower fan to draw in air and to produce an air stream through the outlet, a heating element disposed between the air intake and air outlet, a ion corona discharge adjacent the outlet for injecting a continuous supply of ions into the air stream, and control switches including a corona discharge on/off switch, blower fan switch, heating element switch and a power on/off sensor switch, all carried on the handle.

2. The hand-held hair dryer of claim 1, and further including a self-contained cord retractor contained within said housing.

3. The hand-held hair dryer of claim 1, wherein the corona discharge operates between a charged pin and a grounded metal or metallized grid in the outlet of the barrel.

4. The hand-held hair dryer of claim 1, wherein the power on/off sensor switch comprises an infrared switch or a capacitance switch.

5. The hand-held hair dryer of claim 2, and further including a fail-safe microswitch for preventing operation of the drier unless the electric cord is unreeled.

6. The hand-held hair drier of claim 1, and further comprising a control panel having an elastomeric membrane sealed to the handle and covering a plurality of touch sensitive control buttons or switches.

7. The hand-held hair dryer of claim 6, wherein the control buttons or switches include separate buttons or switches to control blower fan speed, heating element and corona discharge.

8. The hand-held hair dryer of claim 6, wherein said control panel includes one or more indicator lights.

9. The hand-held hair dryer of claim 1, and further including a rechargeable battery housed within the device and rechargeable through a connection thereto.

10. A hand-held hair dryer comprising:

a housing including an elongated barrel connected to a handle, said barrel having an air intake and air outlet, a variable speed blower fan to draw in air and to produce an air stream through the outlet, a heating element disposed between the air intake and air outlet, and control switches including a power on/off sensor switch carried on the handle.

11. The hand-held hair dryer of claim 10, wherein the power on/off sensor switch comprises an infrared switch or a capacitance switch.

12. The hand-held hair dryer of claim 10, and further including a self-contained cord retractor contained within said housing.

13. The hand-held hair dryer of claim 12, and further including a fail-safe microswitch for preventing operation of the drier when the electric cord is in a reeled position.

14. The hand-held hair drier of claim 10, and further comprising a control panel having an elastomeric membrane sealed to the handle and covering a plurality of touch sensitive control buttons or switches.

15. The hand-held hair dryer of claim 14, wherein the control buttons or switches include separate buttons or switches to control blower fan speed and heating element.

16. The hand-held hair dryer of claim 14, wherein said control panel includes one or more indicator lights.

17. The hand-held hair dryer of claim 10, and further including a rechargeable battery housed within the device and rechargeable through a connection thereto.

18. A hand-held hair dryer comprising:

a housing including an elongated barrel connected to a handle, said barrel having an air intake and air outlet, and a control panel having an elastomeric membrane scaled to the handle and covering a plurality of touch sensitive control buttons or switches.

19. The hand-held hair dryer of claim 18, and further including a self-contained cord retractor contained within said housing.

20. The hand-held hair dryer of claim 19, and further including a fail-safe microswitch for preventing operation of the drier when the electric cord is in a reeled position.

21. The hand-held hair dryer of claim 18, wherein the control buttons or switches include separate buttons or switches to control blower fan speed and heating element.

22. The hand-held hair dryer of claim 18, wherein said control panel includes one or more indicator lights.

23. The hand-held hair dryer of claim 18, and further including a rechargeable battery housed within the device and rechargeable through a connection thereto.

* * * * *

UNITED STATES PATENT AND TRADEMARK OFFICE

CERTIFICATE OF CORRECTION

PATENT NO. : 6,393,718 B1
DATED : May 28, 2002
INVENTOR(S) : Harris et al.

It is certified that error appears in the above-identified patent and that said Letters Patent is hereby corrected as shown below:

Column 6,
Line 8, "scaled" should be -- sealed --.

Signed and Sealed this

Third Day of December, 2002

JAMES E. ROGAN
*Director of the United States Patent and Trademark Office*